US010105028B2

(12) United States Patent
Noh et al.

(10) Patent No.: US 10,105,028 B2
(45) Date of Patent: Oct. 23, 2018

(54) CLEANER

(71) Applicant: LG ELECTRONICS INC., Seoul (KR)

(72) Inventors: Dongki Noh, Seoul (KR); Seungmin Baek, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 463 days.

(21) Appl. No.: 14/716,349

(22) Filed: May 19, 2015

(65) Prior Publication Data

US 2015/0335219 A1 Nov. 26, 2015

(30) Foreign Application Priority Data

May 20, 2014 (KR) ..... 10-2014-0060572

(51) Int. Cl.
*A47L 9/30* (2006.01)
*A47L 9/28* (2006.01)

(52) U.S. Cl.
CPC ..... *A47L 9/2857* (2013.01); *A47L 9/2826* (2013.01); *A47L 9/2842* (2013.01); *A47L 9/2852* (2013.01); *A47L 9/30* (2013.01); *A47L 2201/04* (2013.01); *A47L 2201/06* (2013.01)

(58) Field of Classification Search
CPC .... A47L 9/2857; A47L 9/2852; A47L 9/2842; A47L 9/30; A47L 9/2826; A47L 2201/06; A47L 2201/04
See application file for complete search history.

(56) References Cited

U.S. PATENT DOCUMENTS 6,968,592 B2 * 11/2005 Takeuchi ..... A47L 9/009 15/319
7,526,362 B2 * 4/2009 Kim ..... G08C 23/04 318/567
8,606,404 B1 * 12/2013 Huffman ..... B25J 9/1697 700/259
9,002,482 B2 * 4/2015 Tsuboi ..... G05D 1/0033 318/12
2002/0138936 A1 10/2002 Takeuchi et al.
2005/0027399 A1 * 2/2005 Koh ..... G05D 1/0221 700/258
2014/0180525 A1 * 6/2014 Tsuboi ..... G05D 1/0033 701/23
2016/0274579 A1 * 9/2016 So ..... A47L 9/2852

FOREIGN PATENT DOCUMENTS

DE 102009059215 A1 2/2011
JP 3849442 B2 11/2006
JP 2007-199965 A 8/2007
JP 2007199995 A 8/2007
KR 1020120017847 A 2/2012

* cited by examiner

*Primary Examiner* — Peter D Nolan
(74) *Attorney, Agent, or Firm* — Dentons US LLP

(57) ABSTRACT

Disclosed herein is a cleaner including a main body for sucking dust on the floor in a cleaning region while actively traveling, and a marker indication device for indicating a marker on the floor in the cleaning region while moving independently of the main body, wherein the main body includes an image acquisition unit acquiring a front image thereof, and a controller to track a movement trajectory of the marker on the acquired image, set a traveling path, in an actual space, corresponding to the movement trajectory, and control the main body such that the main body travels along the set traveling path.

13 Claims, 5 Drawing Sheets

CLEANER

CROSS-REFERENCE TO RELATED APPLICATION

This application claims the priority benefit of Korean Patent Application No. 10-2014-0060572, filed on May 20, 2014 in the Korean Intellectual Property Office, the disclosure of which is incorporated herein by reference.

BACKGROUND OF THE INVENTION

1. Field of the Invention

The present invention relates to a cleaner.

2. Description of the Related Art

Cleaners are apparatuses to suck dust from the floor. Such cleaners may be classified into a passive traveling cleaner which passively travels by force pushed or pulled by a user and an active traveling cleaner which autonomously travels.

In recent years, the active traveling cleaner has various functions of providing various preprogrammed traveling paths such that the user may select the paths or of autonomously detecting obstacle circumstances (for instance, walls or door sills) in a cleaning region to set a proper path for traveling of the cleaner.

Furthermore, the active traveling cleaner also provides a designated region cleaning function for allowing the user to arbitrarily designate a traveling region of the cleaner in recent years. Incidentally, the designated region cleaning function is a function in which, when the user operates a remote control such that the cleaner travels along a user's desired path, the cleaner stores the traveling path and then travels along the stored path when a designated region cleaning command is input to the cleaner later. In a cleaning manner using such a function, the cleaner should travel once for region designation and it takes a long time until the region designation is completed, considering traveling speed of the cleaner. For this reason, there are problems in that it takes a long time for the user to operate the remote control and it is very cumbersome for the user to change the region designation.

SUMMARY OF THE INVENTION

Therefore, the present invention has been made in view of the above problems, and it is an object of the present invention to provide a cleaner in which a user may arbitrarily designate a traveling path of a main body and the traveling path may be more easily and rapidly designated and changed.

In addition, it is another object of the present invention to provide a cleaner capable of previously setting a designated path, independently of traveling of a main body.

In addition, it is still another object of the present invention to provide a cleaner in which a traveling path may be more intuitively designated.

In addition, it is a further object of the present invention to provide a cleaner capable of accurately avoiding obstacles in a cleaning region and designating a traveling path.

In accordance with an aspect of the present invention, the above and other objects can be accomplished by the provision of a cleaner including a main body for sucking dust on the floor in a cleaning region while actively traveling, and a marker indication device for indicating a marker on the floor in the cleaning region while moving independently of the main body, wherein the main body includes an image acquisition unit acquiring a front image thereof, and a controller configured to track a movement trajectory of the marker on the acquired image, to set a traveling path, in an actual space, corresponding to the movement trajectory, and to control the main body such that the main body travels along the set traveling path.

The marker indication device may include a luminous body marked as the marker. The luminous body may include at least one of an LED (Light Emitting Diode) or an infrared light source. The marker indication device may include the luminous body disposed at a lower portion thereof, and a support leg for supporting the luminous body in a state in which the luminous body is spaced apart from the floor in the cleaning region. The marker indication device may further include a rod, at a lower end portion of which the luminous body is disposed, and the support leg supports the rod. The marker indication device may further include a handle provided at an upper end portion of the rod to be gripped by a user.

The marker indication device may include at least one wheel disposed at the support leg to roll along the floor in the cleaning region.

The marker indication device may have a center of gravity positioned at a lower side thereof close to the floor on which the main body travels.

The marker may be located at a lower position than an optical axis of the image acquisition unit.

The marker indication device may include an optical pointer for radiating light to a remote site so as to form a spot marked as the marker on the floor in the cleaning region. The optical pointer may radiate laser light.

The controller may include a marker information acquisition module acquiring information on a movement trajectory of the marker in the actual space, based on the movement trajectory of the marker on the image, a traveling path setting module setting the traveling path, based on the information on the movement trajectory of the marker, and a traveling control module controlling the main body such that the main body travels along the set traveling path.

The main body may include a suction unit for sucking the dust, and a dust collection container for collecting the dust sucked through the suction unit.

The marker indication device may be configured to move a position of the marker.

BRIEF DESCRIPTION OF THE DRAWINGS

The embodiments will be described in detail with reference to the following drawings in which like reference numerals refer to like elements wherein.

DETAILED DESCRIPTION OF THE PREFERRED EMBODIMENTS

Advantages, features and methods for achieving those of embodiments may become apparent upon referring to embodiments described later in detail together with attached drawings. However, embodiments are not limited to the embodiments disclosed hereinafter, but may be embodied in different modes. The embodiments are provided for perfection of disclosure and informing a scope to persons skilled in this field of art. The same reference numbers may refer to the same elements throughout the specification.

Figure 1:
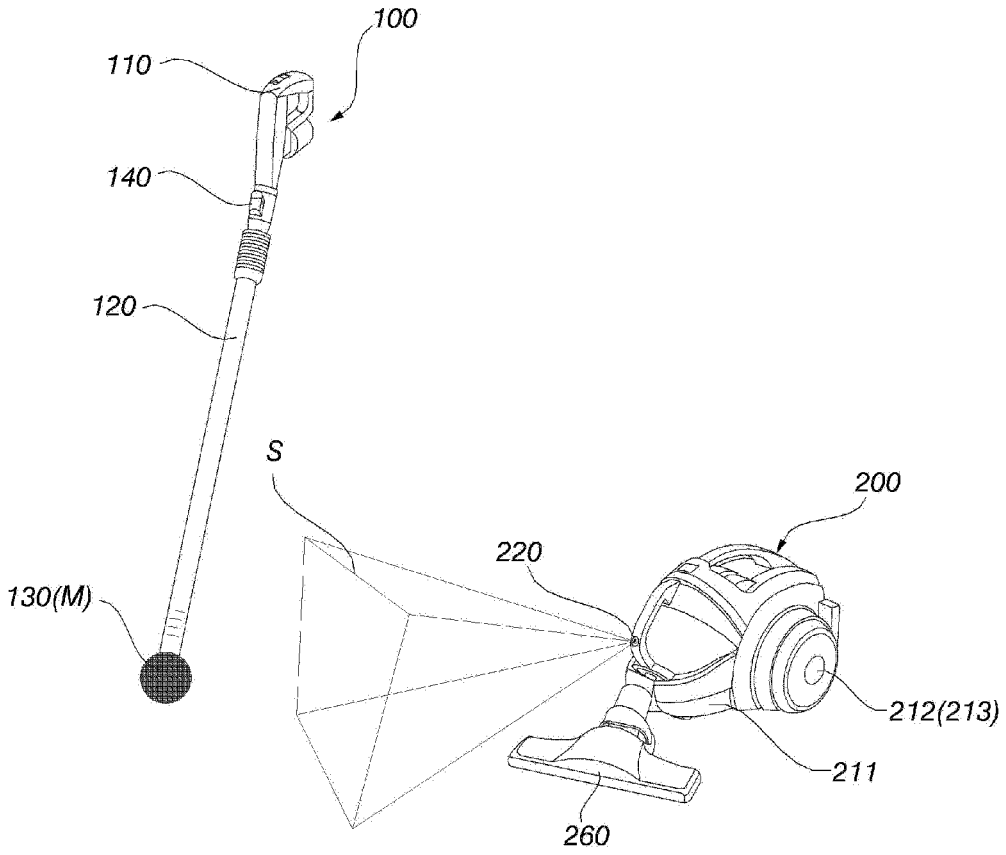
FIG. 1 is a view illustrating a cleaner according to an embodiment of the present invention.
Figure 2:
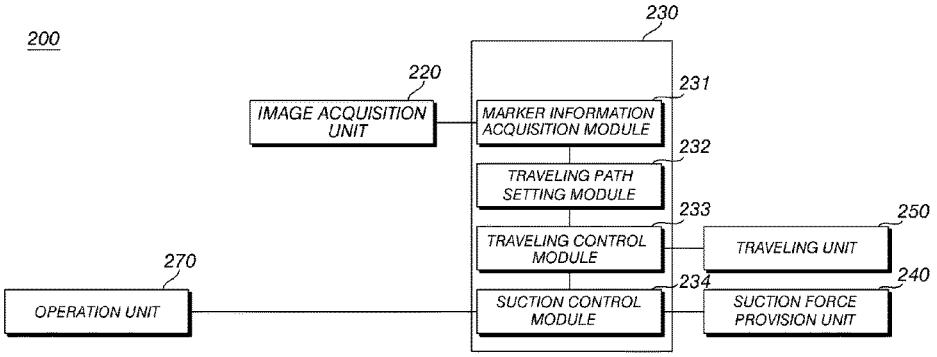
FIG. 2 is a block diagram illustrating main components of a main body.
Figure 3:
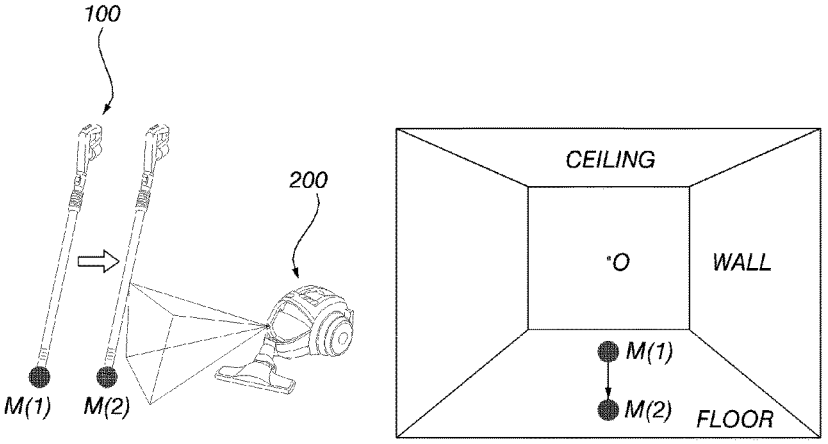
FIG. 3 is a view illustrating a change in position of a marker on an acquired image when a position of the marker accesses to the main body.
Figure 4:
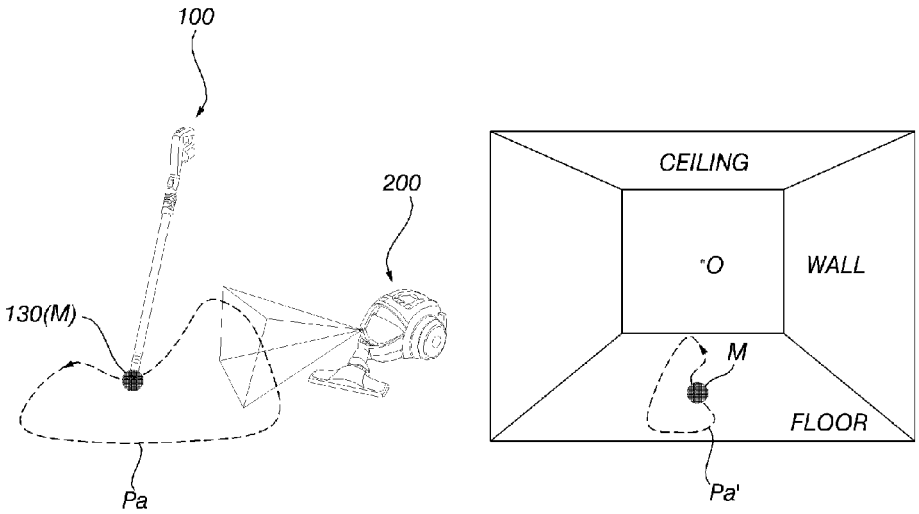
FIG. 4 is a view illustrating a designated path Pa formed by movement of the marker along the floor in a cleaning region, and a movement trajectory Pa' of the marker displayed on the acquired image, corresponding to the designated path Pa.

FIG. 1 is a view illustrating a cleaner according to an embodiment of the present invention. FIG. 2 is a block diagram illustrating main components of a main body. FIG. 3 is a view illustrating a change in position of a marker on an acquired image when a position of the marker accesses to the main body. FIG. 4 is a view illustrating a designated path Pa formed by movement of the marker along the floor in a cleaning region, and a movement trajectory Pa' of the marker displayed on the acquired image, corresponding to the designated path Pa.

Referring to FIGS. 1 to 4, the cleaner according to the embodiment of the present invention includes a main body 200 for sucking dust on the floor in a cleaning region while actively traveling, and a marker indication device 100 for indicating a marker M on the floor in the cleaning region while moving independently of the main body 200.

The main body 200 includes an image acquisition unit 220 which acquires a surrounding image thereof, and a controller 230 which tracks a movement trajectory Pa' of the marker M on an image acquired by the image acquisition unit 220 (hereinafter, referred to as "acquired image"), sets a traveling path Pa, in an actual space, corresponding to the movement trajectory Pa', and controls the main body 200 such that the main body 200 travels along the set traveling path Pa.

In more detail, the main body 200 may include a case 211 defining an external appearance thereof so as to receive various components therein, and at least one wheel 212 or 213 which is rotatably installed to the case 211. The main body 200 may move straight and change its direction by the wheel 212 or 213. In the embodiment, left and right wheels 212 and 213 are respectively provided at both left and right sides of the case 211, and the main body 200 changes its direction according to a difference between rotation speeds of the left and right wheels 212 and 213.

The main body 200 may include a traveling unit 250 for rotating the left and right wheels 212 and 213, and the traveling unit 250 may include at least one motor. In the embodiment, the cleaner may also include a pair of motors for respectively driving the left and right wheels 212 and 213, and alternatively may include one motor and a power transfer means for transferring driving force of the motor to the left and right wheels 212 and 213. The change in direction of the main body 200 may be performed according to a difference between rotation speeds of the respective motors in the former case, and may be performed according to a difference between rotation speeds of the left and right wheels 212 and 213 by the power transfer means in the latter case.

The main body 200 may include a suction unit 260 for sucking dust, and a suction force provision unit 240 for providing suction force such that air is introduced through the suction unit 260. The suction force provision unit 240 may form a negative pressure such that outside air is introduced through the suction unit 260, and may include a fan motor (not shown) and a fan (not shown) rotated by the fan motor. The fan motor may be operated by control of a suction control module 234 of the controller 230.

The suction force provision unit 240 may be provided in the case 211. A dust collection container (not shown) in which dust sucked through the suction unit 260 is collected may be disposed in the case 211.

The main body 200 may include an operation unit 270. The operation unit 270 receives a variety of control commands input from a user, and particularly the operation of the suction force provision unit 240 may be controlled through the operation unit 270. The operation unit 270 may be disposed in the case 211, but may be provided as a separate remote control from the main body 200 in the embodiment. For example, the operation unit 270 may be separated from the main body 200 and communicate with the controller 230 in a wireless manner.

The suction control module 234 may control the operation of the suction force provision unit 240 according to the control commands input through the operation unit 270.

The image acquisition unit 220 acquires an image in the cleaning region, and preferably acquires a front image (or an image in a traveling direction) of the main body 200. The image acquisition unit 220 may include a camera, and preferably includes a digital camera for capturing a digital image. The digital camera may be configured such that an optical axis O of a lens is directed forward (or in the traveling direction) of the main body 200.

The user operates the marker indication device 100, thereby enabling a position of the marker M to be changed as desired by the user. A marker information acquisition module 231 may acquire information on a movement trajectory of the marker M in the actual space, based on the position change of the marker M displayed on the acquired image. As illustrated in FIG. 4, when the user moves the marker M along a desired designated path Pa using the marker indication device 100 separated from the main body 200, the marker information acquisition module 231 may track a movement trajectory Pa' of the marker M corresponding to the designated path Pa through the acquired image. The position of the marker M on the acquired image is changed according to a distance or movement direction of the marker M relative to the main body 200. As illustrated in FIG. 3, when the position of the marker M accesses to the main body 200 in the actual space (M(1)→M(2)), the position of the marker M displayed on the acquired image is changed from the upper side to the lower side. In this case, the marker M is displaced in a region beneath the optical axis O of the image acquisition unit 220. Although not illustrated in the drawings, it is apparent that the position of the marker M is also changed in left and right directions on the acquired image corresponding to displacement of the marker M in left and right directions in the actual space.

Since the image acquisition unit 220 has a fixed visual field, a coordinate on the acquired image reflects position information from the main body 200 to a point corresponding to the coordinate in the actual space. The position information may include information on a distance from the main body 200 to the point or a direction in which the point is located relative to the main body 200. As a coordinate on the acquired image is determined, position information from the main body 200 to a point, in the actual space, corresponding to the coordinate may be previously stored in a database. The marker information acquisition module 231 may acquire position information of the marker M, based on the database. The position information of the marker M acquired by the marker information acquisition module 231 is changed as the marker indication device 100 is moved, and the marker information acquisition module 231 may acquire information on a movement path of the marker M, namely, a designated path Pa in the actual space, based on the changed position information.

A traveling path setting module 232 may set a traveling path corresponding to the movement trajectory Pa' of the marker M on the acquired image. Here, the traveling path is determined based on the information of the designated path Pa acquired by the marker information acquisition module 231, and corresponds to the movement trajectory of the marker M in the actual space. The controller 230 may control the main body 200 such that the main body 200 travels along the traveling path based on the set traveling path. Such a process may be performed through control of the traveling unit 250 by a traveling control module 233.

The traveling path set by the traveling path setting module 232 may be stored in a removable/rewritable recording medium (not shown) such as RAM. The stored information of the traveling path is loaded when a designated region cleaning function is performed later, so as to be used to control the traveling of the main body 200. For example, the operation unit 270 may be provided with a menu for selection of the designated region cleaning function. When the user operates the operation unit 270 to select the designated region cleaning function, the traveling of the main body 200 may be controlled according to the information of the traveling path pre-stored in the recording medium.

In addition, the operation unit 270 may be provided with a reset menu for selection of resetting of the designated region. When the reset menu is selected by the user, the information of the traveling path pre-stored in the recording medium is removed and a new traveling path according to the movement of the marker indication device 100 may be set.

Meanwhile, the marker M should have discrimination by which the marker is apparently contrasted with the background, and such discrimination is not preferably influenced by surrounding illumination. The marker may be configured of marker component elements having characteristics such as points, lines, contours, areas, or combination thereof.

With consideration of discrimination with the background, the marker M is preferably brighter than the background. In this regard, the marker M may be classified into a reflective marker having discrimination of high brightness compared to the background by reflecting ambient light, and a self light emitting marker which autonomously emits light.

The reflective marker may be formed by applying high reflective paints onto a surface of an attached object, or may be made of a high reflective material to be attached to the surface of the object. The reflective marker has an advantage in terms of being not subject to an attachment position. However, since the reflective marker has poor discrimination in a low illumination environment, it is preferable to further provide an illuminator for illuminating the marker and the illuminator may be provided in the main body 200.

The marker M according to the embodiment is a light emitting marker, and the marker indication device 100 may include a luminous body 130 marked as the marker M. The luminous body 130 may include an LED (Light Emitting Diode) or an infrared light source. The light emitting marker has an advantage in terms of being identified in a low illumination environment.

Figure 5:
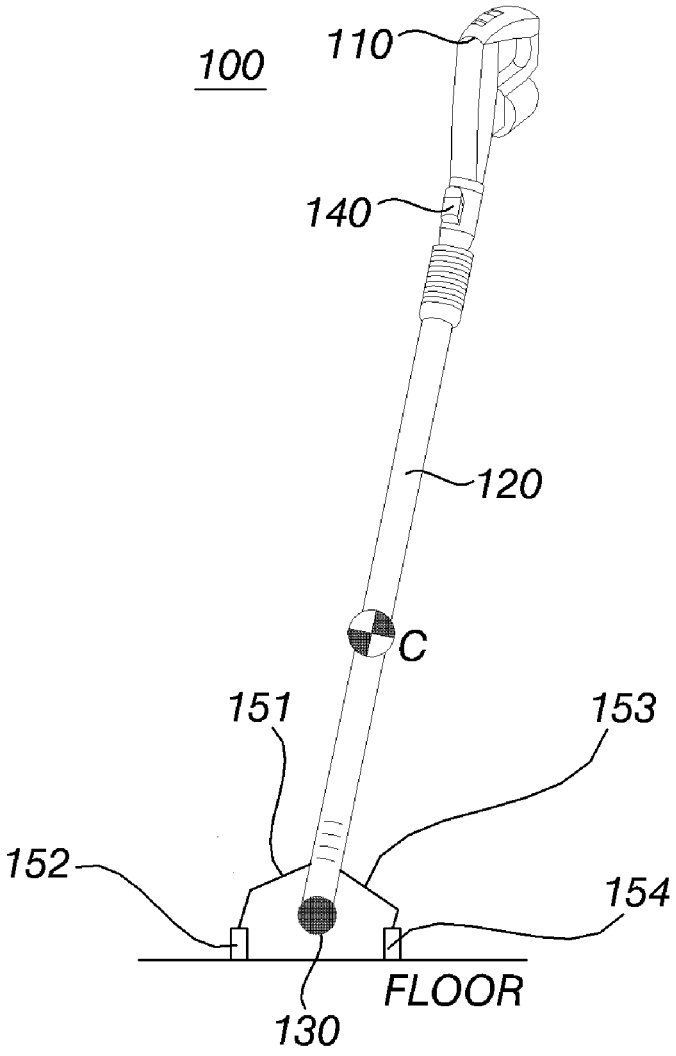
FIG. 5 is a perspective view illustrating another example of a marker indication device.

Referring to FIG. 5, the marker indication device 100 has the luminous body 130 disposed at a lower end portion thereof, and may include support legs 151 and 153 for supporting the luminous body 130 in a state in which the luminous body 130 is spaced apart from the floor in the cleaning region. In more detail, the marker indication device 100 may include a rod 120, a lower end portion of which is provided with the luminous body 130, and the support legs 151 and 153 may support the rod 120. The support legs 151 and 153 may be configured of at least one (preferably two or more) support leg and may extend from the rod 120, so as to stably support the rod 120. A handle 110 gripped by the user may be provided at an upper end portion of the rod 120. In addition, a switch 140 for turning on or off the luminous body 130 may be provided at the upper end portion of the rod 120.

The support legs 151 and 153 may have wheels 152 and 154 rolling along the floor in the cleaning region such that the user easily moves the marker indication device 100. Although the wheels 152 and 154 are respectively provided at the two support legs 151 and 153 in the embodiment, the number of support legs and wheels is not necessarily limited thereto.

Since the main body 200 travels on the floor in the cleaning region, the marker M is preferably moved at a height close to the floor in the cleaning region. In this regard, the marker indication device 100 preferably has a center of gravity C positioned at a lower side thereof such that the marker indication device 100 is naturally put on the floor in the cleaning region when moved by the user. Since the center of gravity C is positioned at the lower side of the marker indication device 100, the marker indication device 100 may be stably moved. It is preferable that the center of gravity C is positioned below half of a height from the floor in the cleaning region to an upper end of the marker indication device 100, namely, is positioned at a lower side of the marker indication device 100 close to the floor in the cleaning region, on which the main body 200 travels. The marker M is preferably located at a lower position than the optical axis O of the image acquisition unit 220.

Figure 6:
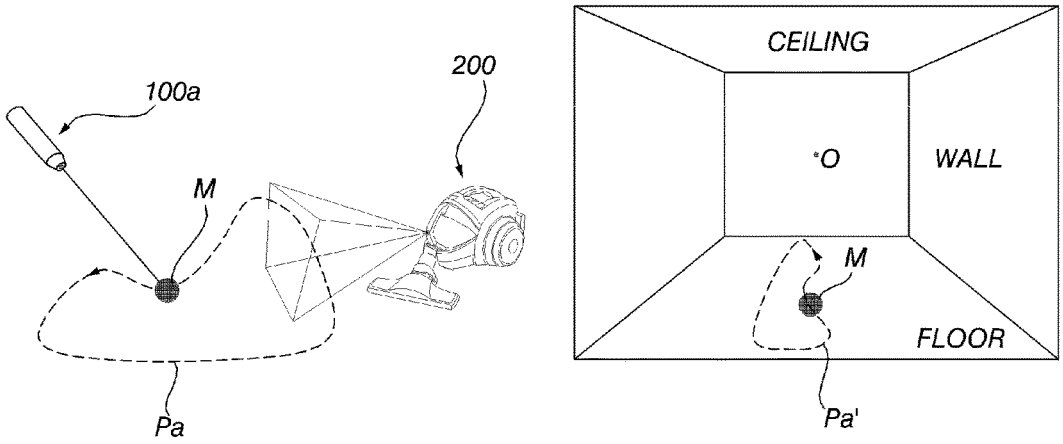
FIG. 6 is a perspective view illustrating a further example of the marker indication device.

FIG. 6 is a perspective view illustrating a further example of the marker indication device. Referring to FIG. 6, the marker indication device according to the embodiment of the present invention may include an optical pointer **100*a* which radiates light to a remote site so as to form a spot marked as the marker M on the floor in the cleaning region. The optical pointer 100*a*** may include a light source for emitting laser light. Particularly, the laser light has excellent monochromatic, straight, and connection characteristics compared to other light sources, thereby allowing identification of the marker M to be improved.

The optical pointer **100*a*** may designate a traveling path by radiating light in any direction in place, and thus it is very convenient. Particularly, it is not cumbersome for the user to directly move along the designated path as in the above example.

In accordance with the cleaner of the present invention, the user may arbitrarily designate a traveling path of the main body and the traveling path may be more easily and rapidly designated and changed.

In addition, it is not necessary for the main body to travel in order to store a designated traveling path, and thus it may be possible to prevent the main body from unnecessarily traveling.

In addition, since the marker is moved in the actual cleaning space, the traveling path may be more intuitively designated. Thus, a desired region may be accurately cleaned, and particularly it may be possible to designate a traveling path in which obstacles in the cleaning region are accurately avoided through the sight of the user.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A cleaner apparatus comprising:

a main body for suctioning dust particles in a cleaning region while traveling; and a marker indication device to indicate a marker in the cleaning region while the marker indication device moves independently of the main body, wherein the main body comprises:

an image acquisition unit to acquire a surrounding image thereof; and a controller to track a movement trajectory of the marker on the acquired image, set a traveling path in an actual space that corresponds to the tracked movement trajectory, and control the main body such that the main body travels along the set traveling path, wherein the marker indication device comprises a luminous body marked as the marker, wherein the marker indication device comprises:

the luminous body disposed at a lower portion of the marker indication device; and a support leg to support the luminous body when the luminous body is spaced apart from a floor surface in the cleaning region.

2. The cleaner apparatus of claim 1, wherein the luminous body comprises at least one of an light emitting diode or an infrared light source.

3. The cleaner apparatus of claim 1, wherein the marker indication device further comprises a rod, whereby the luminous body is disposed at a lower end portion of the rod, and the rod is supported by the support leg.

4. The cleaner apparatus of claim 3, wherein the marker indication device further comprises a handle disposed at an upper portion of the rod to be handled by a user.

5. The cleaner apparatus of claim 1, wherein the marker indication device comprises at least one wheel that is connected to the support leg and rolls on the floor surface of the cleaning region.

6. The cleaner apparatus of claim 1, wherein a center of gravity of the marker indication device is positioned at a lower portion of the marker indication device.

7. The cleaner apparatus of claim 1, wherein the marker is located at a lower height than an optical axis of the image acquisition unit.

8. The cleaner apparatus of claim 1, wherein the marker indication device comprises an optical pointer to radiate light so as to form a spot marked as the marker on the floor surface of the cleaning region.

9. The cleaner apparatus of claim 8, wherein the optical pointer radiates a laser light.

10. The cleaner apparatus of claim 1, wherein the controller comprises:

a marker information acquisition module to acquire information of a movement trajectory of the marker in the actual space, based on the movement trajectory of the marker on the acquired image;

a traveling path setting module to set the traveling path based at least in part on the information of the movement trajectory of the marker; and a traveling control module to control the main body such that the main body travels along the set traveling path.

11. The cleaner apparatus of claim 1, wherein the main body comprises:

a suction unit to suction the dust particles; and a dust collection container to collect the suctioned dust particles.

12. The cleaner apparatus of claim 1, wherein the marker indication device changes a position of the marker.

13. The cleaner apparatus of claim 1, wherein a center of gravity of the marker indication device is positioned less than half of a distance from the floor surface in the cleaning region to an upper end of the marker indication device.

* * * * *